United States Patent [19]

Besik

[11] Patent Number: 5,003,961

[45] Date of Patent: Apr. 2, 1991

[54] APPARATUS FOR ULTRA HIGH ENERGY EFFICIENT HEATING, COOLING AND DEHUMIDIFYING OF AIR

[76] Inventor: Ferdinand K. Besik, 2562 Oshkin Ct., Mississauga, Ontario, Canada, L5N 3Z3

[21] Appl. No.: 232,856

[22] Filed: Aug. 16, 1988

Related U.S. Application Data

[63] Continuation-in-part of Ser. No. 152,808, Feb. 5, 1988, Pat. No. 4,952,283.

[51] Int. Cl.[5] ..... F24H 7/04

[52] U.S. Cl. ..... 126/110 R; 126/117; 165/4; 165/7

[58] Field of Search ..... 165/4, 7, 54, 97; 62/271; 126/110 R, 110 A, 110 AA, 110 D, 117

[56] References Cited

U.S. PATENT DOCUMENTS

| | | | |
|---|---|---|---|
| 3,263,400 | 8/1966 | Hoke et al. | 165/4 |
| 3,695,250 | 10/1972 | Rohrs et al. | 126/110 R |
| 3,741,286 | 6/1973 | Muhlrad | 165/4 |
| 3,870,474 | 3/1975 | Houston | 165/4 |
| 3,941,185 | 3/1976 | Henning | 165/4 |
| 4,299,561 | 11/1981 | Stokes | 165/4 |

*Primary Examiner*—Albert W. Davis, Jr.

[57] ABSTRACT

A compact apparatus for ultra high energy efficient heating, cooling and dehymidifying of air for use in heating, cooling and heat recovery ventilation of buildings comprises two matrix containers and a fuel combustor for generating useful heat, with the two matrix containers housing stationary matrices of solid materials providing alternately high energy efficient: (a) transfer of energy from combustion products and exhausted air to incoming make up air, (b) indirect evaporative cooling, (c) indirect-direct evaporative cooling (d) dehumidification-indirect evaporative cooling, (e) dehumidification-indirect-direct evaporative cooling.

A continuous alternate and conuntercurrent flow of two air streams through the two matrix containers and a continuous flow of the air through the apparatus is maintained by alternately operating air fans controlled by solid state processor.

The apparatus intended for use in buildings automatically maintains comfort and quality of the air in the occupied space of the building during the winter heating season, summer cooling season, and the rest of the year—ventilating season, and can be also effectively used in numerous industrial heating, dehumidifying and cooling operations.

20 Claims, 4 Drawing Sheets

APPARATUS FOR ULTRA HIGH ENERGY EFFICIENT HEATING, COOLING AND DEHUMIDIFYING OF AIR

CROSS-REFERENCE TO RELATED APPLICATION

This application is a continuation-in-part of my earlier application Ser. No. 07/152,808 filed Feb. 5, 1988 now U.S. Pat. No. 4,952,283 granted Aug. 28, 1990.

FIELD OF INVENTION

The present invention relates to an apparatus for heating and indirect-direct evaporative cooling of air for use in heating, cooling and heat recovery ventilation of buildings or for heating and cooling of air or an industrial gas for use in industrial processes.

BACKGROUND TO THE INVENTION

Due to energy conservation awareness of the public and the building industry, new standards for energy efficient buildings include more stringent requirements on air tightness, insulation, mechanical ventilation, air quality, and space heating-cooling loads.

As the loads for heating-cooling of the more energy efficient housing has been reduced, their air tightness brought up a need for a continuous mechanical exchange of indoor air with outdoor air to avoid potential health hazards and or house damage problems. Consequently, ventilation of new houses has become one of the required standard air conditioning services.

At present the space heating services in houses and large buildings are provided by various makes of appliances or systems including conventional warm air central heating, hydronic or water circulating central heating systems or an electric or fossil fuel fired unitary systems. For the central systems energy sources may be any fossil fuel or electric power, and the central furnaces and boilers may be conventional, high efficiency or ultra high efficiency condensing types.

The cooling systems may include indirect, direct or a combination of indirect-direct evaporative cooling systems, absorption chillers and mechanical compression systems with the absorption and mechanical compression systems providing simultaneously the required dehumidification and with the evaporative cooling systems providing the required humidification.

The required ventilation is provided by various heat recovery ventilation systems build around various types of air to air heat exchangers equipped with defrost controls and with various effectiveness ratings. At below freezing temperatures the majority of these systems suffer build up of ice causing significant reduction in the heat recovery effectiveness and air delivery capacities.

The space heating, cooling and ventilation services provided by various individual appliances or by integrated systems are capital expensive and are increasing the buildings' capital and operating costs.

Considerable technical literature is available on the heat and mass transfer theory and design and operation of the various heating systems and the indirect-direct evaporative cooling systems. The packed bed regenerative heat exchangers and dryers are described in detail in W. M. Kays, A. L. London, "Compact heat exchangers", McGraw Hill Co., sec. ed., 1964; W. H. McAddams, "Heat Transmission" 3rd ed., McGraw Hill Book Co., 1954; P. C. Wancat, "Large-scale Adsorption and Chromatography", CRC Press Inc., 1986.

Examples of packed bed collecting and releasing of heat in a continuous cyclic operation are the checkwork regenerators used with the steel and glass melt furnaces and for transferring of moisture the various desiccant based air dryers and sorption separation systems used by process industries.

Systems involving heat transfer use a matrix which may be a fixed bed, a moving bed, or a rotating bed which may be a disc, drum or wheel and containing a suitable heat and moisture absorbing material.

The fixed bed systems may use a single, two, or more fixed packed beds of solid materials, and are provided with a quick closing valve arrangement and ducting permitting the cycling of the two air streams between the individual beds.

The fixed bed systems due to the inherent simplicity of the fixed bed are widely used in industrial process applications, however, the required quick closing valving and the required ducting is expensive, subject to wear and considerable maintenance, and a source of significant loss of energy.

The present invention which is utilizing the fixed bed heat transfer theory in achieving the ultra high energy efficient heating and cooling of air, therefore has as one of its objects the provision of an improved apparatus for high energy efficient heating and indirect-direct evaporative cooling of air at reduced capital and operating costs.

Another object is the provision of a compact apparatus for ultra high energy efficient heating of air that would eliminate the possibility of leakage and contamination of the heated air by combustion products.

Another object is the provision of an apparatus for high energy efficient heating of air that would achieve the ultra-high energy efficiency with avoiding the condensation of the moisture present in combustion products to eliminate the condensate corrosion problems.

Another object is the provision of a simple, inexpensive and high energy efficient apparatus for indirect-direct evaporative cooling of air.

Another object is the provision of an apparatus for cooling of air under conditions of high temperature-high humidity, when the indirect-direct evaporative cooling is ineffective.

Another object is the provision of an apparatus capable of providing the indirect-direct evaporative cooling of air during the periods When the humidity of the ambient air is low, and provide the enhanced evaporative cooling only during the periods when the humidity of the air is high.

Another object is the provision of a compact high energy efficient apparatus for the alternate heating of the air for heating and ventilation of a building during the winter heating season, and cooling of the air for cooling and ventilation of the building during the summer cooling season.

Another object is the provision of a packed bed system that does not require the quick closing valves and the associated ducting.

Still another object is the provision of a compact apparatus for heating, cooling and ventilation of a building suitable for use in small scale installations such as expected in private dwellings or homes, apartment houses, office buildings or the like, as well as in large scale commercial, industrial, residential and institutional buildings and or industrial plants that would operate quietly.

Another object is to provide an apparatus for heating, cooling and ventilation of buildings which requires the simplest ducting and instrumentation.

Another object is the provision of the apparatus that would save fuel and power in heating, cooling and ventilation of buildings.

In the heating, cooling and ventilation field, there have been numerous proposals for improvements in heating, cooling and ventilating systems, and the following U.S. patents were considered in preparation of this application:

U.S. Pat. No. 1,658,198 (J. C. Hosch, Feb. 7, 1928)
U.S. Pat. No. 2,121,733 (Cottrell, F. G., June 21, 1938)
U.S. Pat. No. 2,242,802 (Stramaglia, N., May 20, 1941)
U.S. Pat. No. 3,452,810 (Schmidt, J. H. et al, July 1, 1969)
U.S. Pat. No. 3,870,474 (Houston, R. Mar. 11, 1975)
U.S. Pat. No. 4,398,590 (Leroy, M., Aug. 16, 1983)
U.S. Pat. No. 4,227,375 (Tompkins, L., et al. Oct. 14, 1980)
U.S. Pat. No. 4,299,561 (Stokes, K. J., Nov. 10, 1981)
U.S. Pat. No. 4,596,284 (Honmann, W., June 24, 1986)
U.S. Pat. No. 4,708,000 (Besik, F., Nov. 24, 1987)
U.S. Pat. No. 4,711,097 (Besik, F., Dec. 8, 1987)

SUMMARY OF THE INVENTION

The apparatus of the present invention as described in detail in the preferred embodiments is providing means of particular construction and particular methods for simultaneous heating of air for heating and heat recovery ventilation of a building during the winter heating season, simultaneous cooling of air for cooling and heat rejection ventilation of the building during the summer cooling season, and a heat recovery (rejection) ventilation, or a simple ventilation of the building during the rest of the year-ventilating season, i.e. means and methods including: combustion of fuel, transfer of heat from hot combustion products to air, exhaustion of stale air from the building to outdoors, drawing of outdoor air to indoors, transferring the heat from the exhausted air into the incoming outdoor air (or rejecting the heat from the warm outdoor air to outdoors during summer cooling), indirect-direct evaporative cooling of air, desiccant enhanced cooling of air, and circulating the fresh outdoor air admixed with air withdrawn from the building back into and through the building space.

To provide the high energy efficient heating of air and the ventilation of the building during the heating season, the present invention provides an apparatus in which the heat from combustion products generated in a cyclically operating fuel combustor-heat exchanger and the heat from the exhausted air is recovered by a high energy efficient stationary matrix during one part of an operating cycle, and then released from the matrix into a stream of incoming outdoor air during the other part of the operating cycle.

To provide the ultra high energy efficient cooling of air for cooling and ventilation of the building during the cooling season, the apparatus utilizes the same stationary matrices for indirect-direct evaporative cooling of the air. In the periodic flow type indirect-direct evaporative cooling of the present invention the exhausted air is first adiabatically cooled by direct evaporative cooling in first part of the matrix and then it is used to cool the second part of the matrix during one part of the operating cycle, while during the other part of the operating cycle the incoming outdoor air is first sensibly cooled in the second part of the matrix and then adiabatically cooled by direct evaporative cooling in the first part of the matrix.

The periodic alternate operation of the two matrix containers of the present invention through which two air streams are flowing substantially continuously, alternately and countercurrently to each other, is achieved by air fans controlled by a solid state processor.

Other objects, economies, and novel aspects peculiar to the invention reside in certain details of construction, location, form and mode of operation described herein in conjunction with the annexed drawings.

While the apparatus of the present invention is being described a intended for use in heating, cooling and ventilation of individual homes or large buildings, it is also equally suitable for use in various industrial process heating or cooling operations.

DETAIL DESCRIPTION OF PREFERRED EMBODYMENTS

Since the theory of heating and indirect-direct evaporative cooling of air and the periodic flow type transfer of heat and moisture in matrix type devices is well documented, the following description of the invention is limited to the basic features of the invented apparatus.

Figure 1:
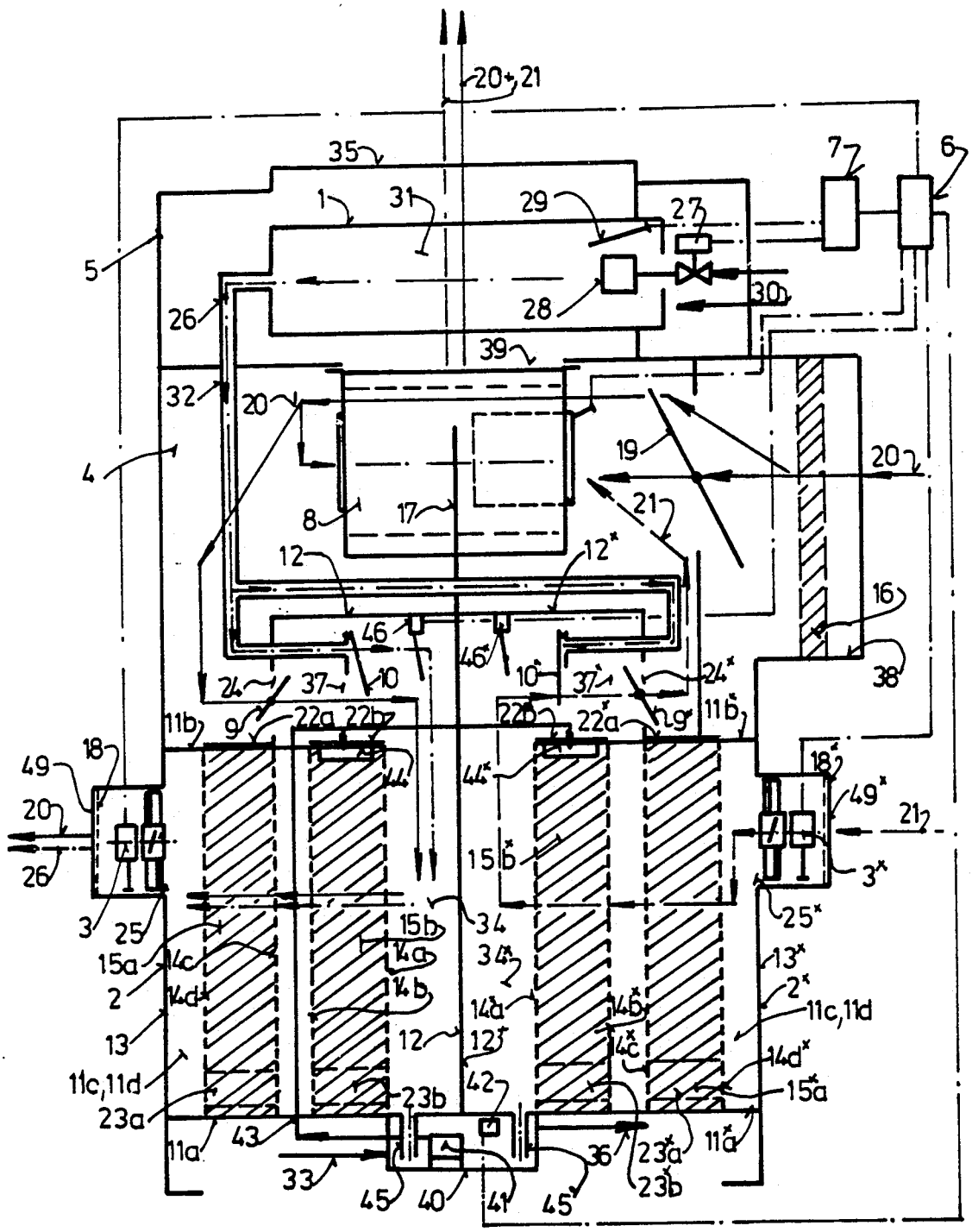
FIG. 1 is a schematic of one preferred embodyment of the apparatus of the present invention intended for use in heating, cooling and ventilation of buildings.

As schematically illustrated in FIG. 1, the invented apparatus intended for use in individual homes as well as in large buildings for central heating, cooling and ventilation comprises a fuel combustor-heat exchanger 1, two identical matrix containers 2,2*, two exhaust fans 3, 3*, a return air compartment 4, a supply air compartment 5, and a solid state processor 6.

The fuel combustor 1 includes combustion chamber 31, burner 28, igniter 29, automatic fuel valve 27 with combustion controls 7, combustion air intake 30, flue gas line 32, and two automatic flue gas discharge check valves 10, 10*.

Check valves 10,10* are of a gravity type and have an extended surface for their automatic operation actuated by the flow of the relatively cool exhaust air or the incoming outdoor air passing through chambers 37, 37*.

The fuel combustor 1 may be of a single combustion chamber type, or it may include any type of a conventional furnace type heat exchanger, with any type of a single or a multiple type atmospheric or induced draft type burners.

The two identical matrix containers 2,2* are generally rectangular, with four side walls **11*a*–11*d*, 11*a**–11*d*, a front wall 12,12* and a rear wall 13, 13*. In the embodyment of FIG. 1 which shows a vertical configuration of the apparatus, the front walls 12, 12* are extended into the return air compartment 4 to provide with the side walls of the return air compartment chambers 37, 37* extending to chambers 34, 34*. Chambers 37, 37* include openings 24, 24* with air dampers 9, 9* for intake of the exhaust air from the return air compartment 4 into containers 2, 2*, and for discharge of the outdoor air from containers 2, 2* into the return air compartment 4**.

The rear walls 13, 13* have openings 25, 25* for discharge of the combustion products admixed with the exhaust air and for intake of the outdoor air through screens 49, 49* and ducts 18, 18* into containers 2, 2*. Flow switches 46, 46* are provided for sensing and proving the flow of the exhaust air through chambers 37, 37* and containers 2, 2*.

The side walls have flanged openings **22*a*, 22*b*, 23*a*, 23*b*,22*a**, 22*b**, 23*a**, 23*b*** for replacement of the matrix materials.

Within each matrix container 2, 2* there are screens **14*a*–14*d*, 14*a**–14*d** separating the container into consecutive chambers provided for two matrix beds 15*a*, 15*b*, 15*a**, 15*b**. Matrix containers 2, 2*** may alternately include a single bed matrix or more parallel matrix beds. Depending on application and the operating temperature the matrix materials may include heat absorbing solids such as ceramic or brick pieces, crushed stone, fired pellets of minerals, conventional ceramic, metal, plastic or wood packings of different shapes, corrugated metal or plastic sheets, expanded metal or plastic, plastic or metal wire, cloth or fibers, adsorbents, or solids impregnated with suitable absorbents. Solids may be mixed or kept separated by screens in parallel layers.

As indicated in the embodyment of FIG. 1, there are two parallel beds **15*a*,15*b*, 15*a**, 15*b****, which may include same or substantially different heat and moisture absorbing materials.

When the apparatus operates in a heating mode, the heat from combustion products and from the exhausted air is transferred to incoming cool outdoor air by both matrix beds **15*a*,15*b*, 15*a**, 15*b****.

When the apparatus operates in a cooling mode, the matrix in beds **15*a*, 15*a** functions as a heat transferring matrix, while beds 15*b*, 15*b** are being wetted and operate as direct evaporative coolers-humidifiers. The water container 40, water pump 41, water level controller 42, water line 43, water distribution channels 44, 44*, make up water line 33 and water sink 36 are provided for washing, humidifying and adiabatic cooling of the exhausted air and the incoming outdoor air passing through beds 15*b*, 15*b**. The water container 40 is in communication with matrix containers 2,2* via drain pipes 45, 45* provided for return of the recirculated water used in beds 15*b*, 15*b****.

The type of the matrix materials or the preferred particle size of solids used in beds **15*a*, 15*b*, 15*a**, 15*b**** is dictated by several factors including temperature of the stream containing the exhaust air and combustion products, the required effectiveness and operating cycle time, the desired physical shape and or weight of packed beds, the cost of the matrix, and the desirable overall pressure drop across the matrix container.

The tube axial fans 3, 3* shown in FIG. 1 are conveniently attached to the rear walls 13, 13* of containers 2, 2 by their housings 18, 18*, and are operating alternately by the processor 6 to facilitate the alternate and countercurrent flow of the exhaust air and the outdoor air through the two containers 2,2* and the substantially continuous flow of the two air streams through the apparatus. Alternately, fans 3, 3* may be any radial type fans sized for the required air flows and pressure drop.

The return air compartment 4 includes an air blower 8 for recirculation of the return-supply air through the apparatus and the building, an air filter 16, air damper 19 for controlling the flow of the return air, partition 17 for directing the fresh outdoor air into blower 8, and intake and exit openings 38, 39 for intake of the return air and discharge of the return air admixed with the fresh outdoor air by blower 8 into and through the supply air compartment 5.

The supply air compartment 5 houses the combustion chamber 31 and serves to heat the supply air. The heated (or cooled) supply air is discharged from the supply air compartment 5 via opening 35 into the supply air distribution ducting of the building (not shown in FIG. 1.).

The return air compartment 4 is in communication with the two matrix containers 2, 2* via intake-exit openings 24, 24* of chambers 37, 37*.

FIG. 1 shows the exhaust air indicated by arrows 20 as being drawn by the exhaust fan 3 from the return air compartment 4 via opening 24 into chamber 37, then together with combustion products indicated by arrows 26 into chamber 34, then into and through beds **15*b*, 15*a* into the exhaust fan 3 and then out via housing-duct 18** to outdoors.

Since the air blower 8 has to generate negative pressure in compartment 4 to draw the return air indicated by arrows 20 from the building, and since this negative pressure can be adjusted and set at the desired level by dampers 9, 9*,19, the air blower 8 is also used to draw the fresh outdoor air indicated by arrows 21, during the period the exhaust fan 3* is off, from outdoors through exhaust fan 3* into container 2*, then through beds **15*a**, 15*b**, chambers 34*, 37* and opening 24* into return air compartment 4, then directed by partition 17 into air blower 8, and finally together with return air forced by air blower 8 into and through supply air compartment 5 and out of the apparatus via opening 35**.

To achieve balanced flow of the two air streams through the two matrix containers 2,2* the total pressure drop across the container during the two heating and cooling periods is set to be the same, i.e. the exhaust fans 3, 3* when operating, each has to generate a negative pressure that is approximately equal to the sum of the overall pressure drop across container 2, 2*, plus the negative pressure generated in the return air compartment 4 by the air blower 8. The negative pressure in the return air compartment is set approximately equal to the overall pressure drop across the matrix container 2, 2* at the desired flow rate of the two air streams. Dampers 9, 9* in openings 24, 24* are used to set the required pressures and flow rates through containers 2,2* for the different conditions required during the heating and cooling operations of the apparatus. Dampers 9, 9*,19 may be operated manually, or automatically when replaced by motorized air dampers.

The alternate periodic operation of exhaust fans 3, 3*, the periodic operation of the combustor 1, and the continuous operation of the air blower 8 is automatic and maintained by the processor 6 which alternately switches on and off the two fans 3, 3* and the burner 28 in the middle of the operating cycle. The duration time of the operating cycle is also controlled by the processor 6.

The processor 6 includes a variable timer and a series of relays interconnected with the room temperature and humidity sensors, combustion controls, exhaust fans 3, 3*, air blower 8, water pump 41 and possibly with the motorized dampers 9, 9*, 19. The actual circuits of the processor 6 and the associated relays are not given in detail inasmuch as any number of different circuits can perform the same function. Since the apparatus of FIG. 1 is intended for heating of air for heating and ventilation of the building during the heating season, and for cooling of air for cooling and ventilation of the building during the summer cooling season, and also for ventilation of the building during the rest of the year, the solid state processor 6 controls and maintains the automatic operation of the apparatus in three different modes including heating, indirect-direct evaporative cooling and ventilating. All operating modes involve the matrix containers 2, 2* operating in same operating cycle comprising substantially two operating periods with the apparatus operating as follows.

When operating in a heating mode:

When the room thermostat calls for heat, processor 6 maintains the continuous alternate on-off operation of exhaust fans 3, 3*, a continuous operation of air blower 8 and the water pump 41 off.

With the alternate countercurrent flow of the exhaust air and the outdoor air through containers 2, 2* maintained by the alternate on-off operation of the exhaust fans 3, 3* and the continuous operation of the blower 8 circulating the return-supply air through the apparatus, as indicated in FIG. 1 and in container 2:

At the start of the heating period when the flow of the exhaust air drawn by air fan 3 from return air compartment 4 into and through opening 24, and chamber 37 of container 2 opens the check valve 10, and the combustion air is drawn by the exhaust fan 3 through combustion chamber 31, flue gas line 32 and valve 10 into chamber 37 and then together with exhaust air through chamber 34 into and through container 2, and when the flow of exhaust air in chamber 37 was sensed and proved by flow switch 46, then processor 6 actuates the igniter 29 and then the fuel valve 27 to cause ignition and burning of the fuel in in burner 28.

During the rest of the heating period, with the combustion of fuel completed in combustion chamber 31, a portion of the heat generated in combustion chamber is transferred to the supply air forced through the supply air compartment 5 by blower 8, with the supply air simultaneously cooling the walls of the combustion chamber 31 and protecting the combustion chamber against overheating by flames and the hot combustion products. The remainder of the heat is then carried by combustion products via line 32 and valve 10 into chamber 37 where the temperature of the combustion products is further reduced by the admixed exhaust air. The resulting warm air stream containing the combustion products and the exhaust air is then drawn by the exhaust fan 3 into and through matrices **15*b*, 15*a* of container 2 and out of the apparatus via duct 18** to outdoors.

When passing through matrix beds **15*b*, 15*a* the hot gas stream is cooled, while the matrix materials in beds 15*b*, 15*a* are being heated by the heat absorbed from the warm air stream. If bed 15*b* includes in addition a desiccant, then moisture from the flue gas and the exhaust air will be adsorbed in bed 15*b* and the associated latent heat will be absorbed in both beds 15*b*, 15*a*** during the heating period, and then released into the outdoor air during the cooling period avoiding the condensation and the associated corrosion problems.

With the two matrix containers 2, 2* operating simultaneously, while the matrix in container 2 is being heated by the warm air stream, the matrix in container 2* is being cooled by the incoming cool outdoor air (cooling period) drawn by air blower 8 from outdoors via duct 18* through the exhaust fan 3*, with exhaust fan 3* being off, into container 2*, then through matrix material in beds **15*a**, 15*b**, where the cool outdoor air is being heated by the previously heated beds, while the beds are being cooled by releasing the previously absorbed heat and moisture into the incoming outdoor air. The outdoor air heated in beds 15*a**, 15*b** is then drawn by blower 8 into and through chambers 34*, 37*, opening 24* into the return air compartment 4 where it is directed by partition 17 into the air blower 8 to be mixed and discharged together with the return air into and through the supply air compartment 5 and then out of the apparatus via opening 35**.

When passing through chamber 37*, the momentum of the outdoor air forces the valve 10* to close, and since the vacuum generated in chamber 37 by exhaust fan 3 is necessarily higher than that in chamber 37* generated by air blower 8, and the valve 10* is kept closed by the flow of the outdoor air in chamber 37*, there is no possibility of leakage of combustion products into the incoming outdoor air.

In the middle of the operating cycle the processor 6 switches off the gas valve 27 and exhaust fan 3 and turns on the exhaust fan 3*. During a following short period of few seconds, while the exhaust fan 3 is slowing down and the exhaust fan 3* is speeding up, with the fuel valve 27 being closed, the exhaust air and the combustion air still being drawn by the slowing down exhaust fan 3 through container 2 and out, the exhaust air displaces the flue gas out of the matrix materials in beds **15*b*, 15*a* and container 2. Thus, when the outdoor air starts flowing into container 2 at the start of the cooling period, and the exhaust air starts flowing out of container 2* at the start of the heating period in container 2*, the packed bed materials in beds 15*b*, 15*a* and container 2 were already washed by the exhaust air and therefore do not contain any residual combustion products. Consequently the carry over contamination of supply air by the combustion products in the apparatus of the present invention is also eliminated. If a longer washing period is needed to clean the matrix materials, such can be provided by the processor 6 switching off the gas valve 27 for such washing period ahead of switching the exhaust fans 3,3***. As described, contamination of the supply air by leakage and carry over of combustion products in the apparatus of the present invention is eliminated.

The next heating period is automatically started in container 2* only after the flow of the exhaust air and combustion air through the container 2* has been fully established and proved by flow switch 46* as already described above for the heating period of container 2.

When operating in a cooling mode:

When the room thermostat calls for cool air, the processor 6 maintains the continuous alternate on-off operation of the exhaust fans 3, 3* and a continuous operation of the air blower 8 and the water pump 41, and the gas valve 27 is closed. The flow of the return air through the return air compartment 4 is continuous and the alternate flow of the cool exhaust air and incoming warm outdoor air through the two containers 2, 2* is countercurrent and substantially balanced. The heat and mass transfer operations occurring in matrix containers 2, 2* are as follows:

As indicated in FIG. 1 in container 2 during the cooling period:

The exhaust fan 3 draws the relatively cool exhaust air from the return air compartment 4 via opening 24 with a small portion of air drawn through the combustion chamber 31, line 32 and valve 10 into and through chambers 37, 34, then through beds 15*b*,15*a* and out via duct 18 to outdoors. The water pump 41 continuously pumps water from the water container 40 via line 43 into the water distribution channels 44, 44* for wetting or spraying the matrix material in beds 15*b*, 15*b. The water flowing downwardly through the matrix material is then collected and drained back into the water container 40 via drain pipes 45, 45***.

When the relatively cool exhaust air passes through the wet matrix in bed 15*b*, it is contacted with the recirculated water and is washed, humidified and adiabatically cooled close to its wet bulb temperature. When the adiabatically cooled exhausted air passes through the sensible heat absorbing material in bed 15*a*, a layer of the heat absorbing material at the entrance of the bed 15*a* is cooled close to the temperature of the adiabatically cooled exhausted air. As the exhaust air passes through the bed, its temperature gradually rises with the temperature of the bed material close to the temperature of the outdoor air at which temperature the exhaust air is finally discharged by the exhaust fan 3 via duct 18 to outdoors.

With the two matrix containers 2, 2* operating simultaneously, while the exhaust air in container 2 is being adiabatically cooled in bed 15*b* and the matrix in bed 15*a* is cooled by the cooled exhaust air, the matrix material in bed 15*a of container 2* is being heated by the incoming warm outdoor air drawn through the container 2* under the influence of the air blower 8, with the outdoor air simultaneously being cooled by the matrix material previously cooled by the exhaust air, with the dry bulb temperature of the outdoor air at the exit from bed 15*a being very close to the dry bulb temperature of the previously adiabatically cooled exhaust air. Because of the large surface area of the matrix material in beds 15*a*, 15*a and because of the perfectly countercurrent flow of the two air streams through the matrix beds in containers 2, 2*, the sensible heat transfer effectiveness as high as 95% in beds 15***a*, 15*a is economically feasible. Finally, when the cooled outdoor air passes through the wet matrix in bed 15*b the cool outdoor air is washed, humidified and further adiabatically cooled to a low temperature at which the fresh outdoor air is drawn by the air blower 8 into the return air compartment 4 and from there discharged by air blower 8 through supply air compartment 5 and via opening 35 out of the apparatus.

When operating in a ventilating mode:

When operating in a ventilating mode, processor 6 maintains the gas valve 27 closed and the operation of the air fans 3, 3*, air blower 8 and the water pump 41 is as described in the following operating alternatives:

with the water pump 41 and the air blower 8 being off, with the two exhaust fans 3, 3* continuously drawing the exhaust air from the return air compartment 4 through both containers 2, 2* and discharging the exhaust air via ducts 18, 18* to outdoors, with the water pump 41 either on or off, the exhaust fans 3, 3* being off, and the damper 19 being closed, with the air blower 8 continuously drawing the outdoor air through the two containers 2, 2* into the building, with the water pump 41 being off, with the air blower 8 operating continuously and the exhaust fans 3, 3* operating alternately.

The heat transfer effectiveness of the matrix containers 2, 2* can be varied by varying the duration time of the operating cycle by the processor 6. Thus, when operating in a heating mode at low below freezing temperatures of the incoming outdoor air, the build up of ice in the matrix materials can be also prevented by extending the duration time of the operating cycle. This may be automatic using temperature sensors controlling the temperature of the discharged exhaust air.

Since build up of ice is prevented either by use of a desiccant or by controlling the duration time of the operating cycle, a defrost cycle or a defrost heater is not needed, and the performance and the ventilation capacity of the invented apparatus even under the sever winter conditions remains unchanged.

Because the two air streams flow through the matrix materials countercurrently to each other, and because of the periodic flow reversals, cleaning of the matrix materials is less frequent than that required by the direct type heat exchangers.

Figure 2:
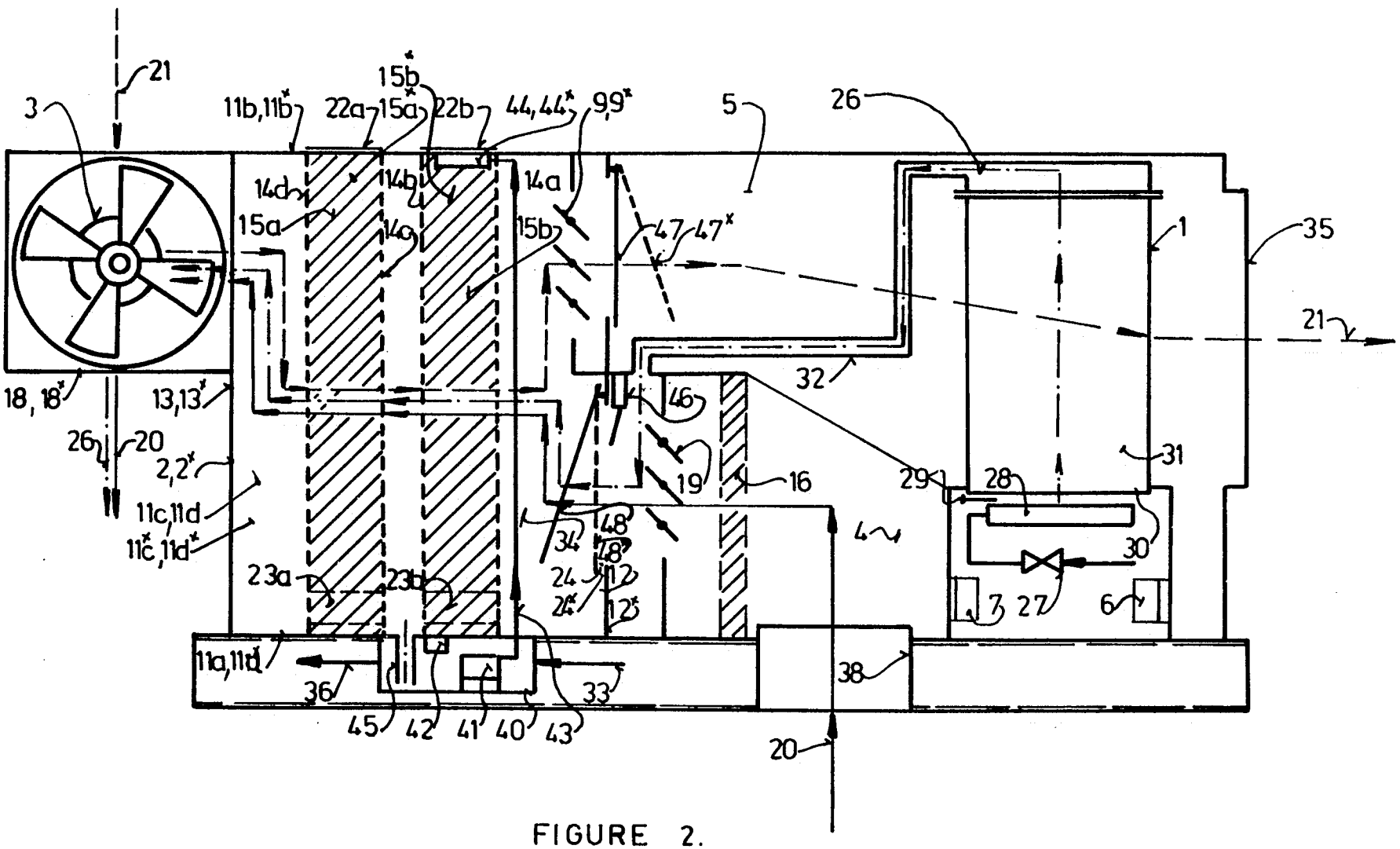
FIG. 2 is a schematic vertical view of another preferred embodyment of the apparatus of the present invention intended for use in heating, cooling and ventilation of buildings.
Figure 3:
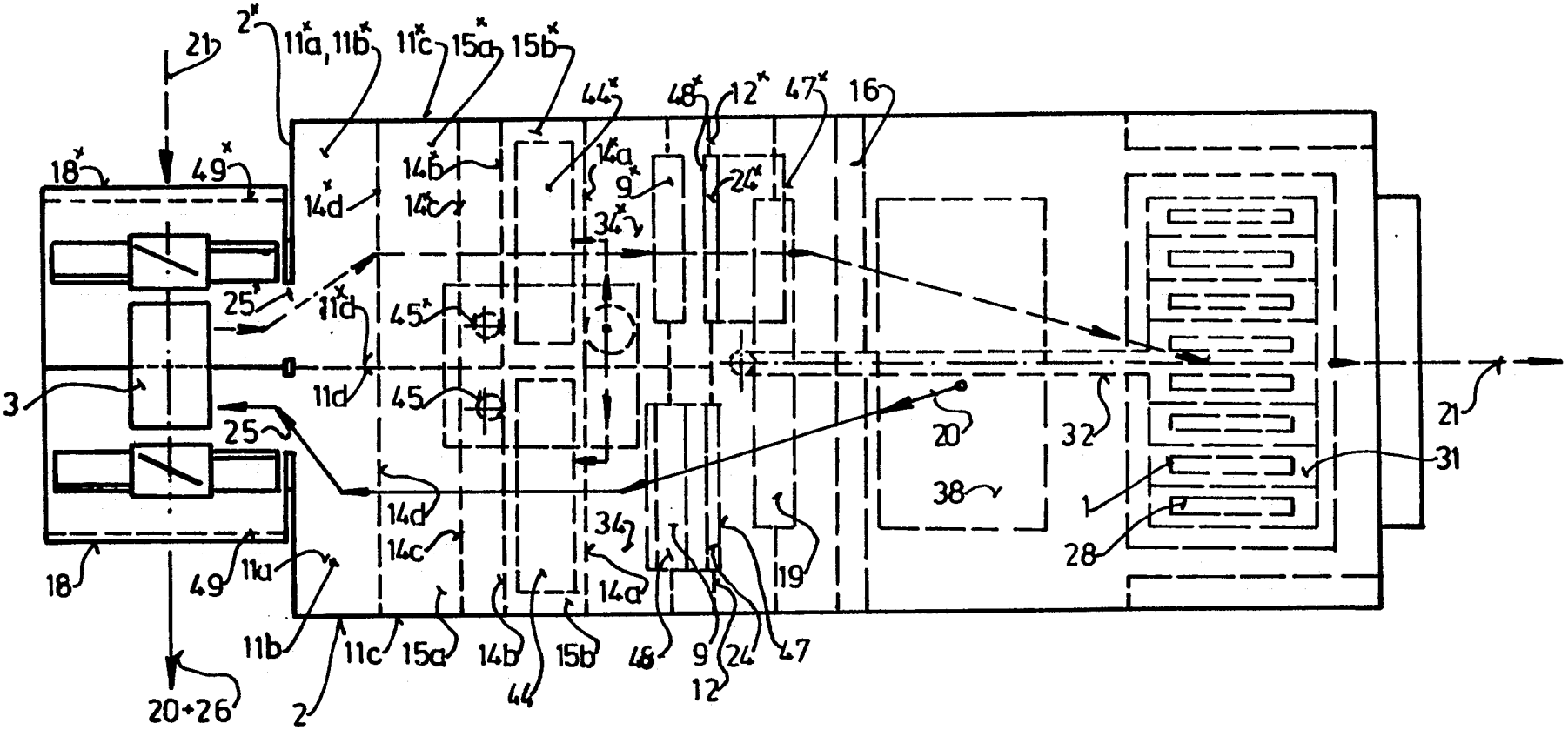
FIG. 3 is a schematic layout of the apparatus of FIG. 2.
Figure 4:
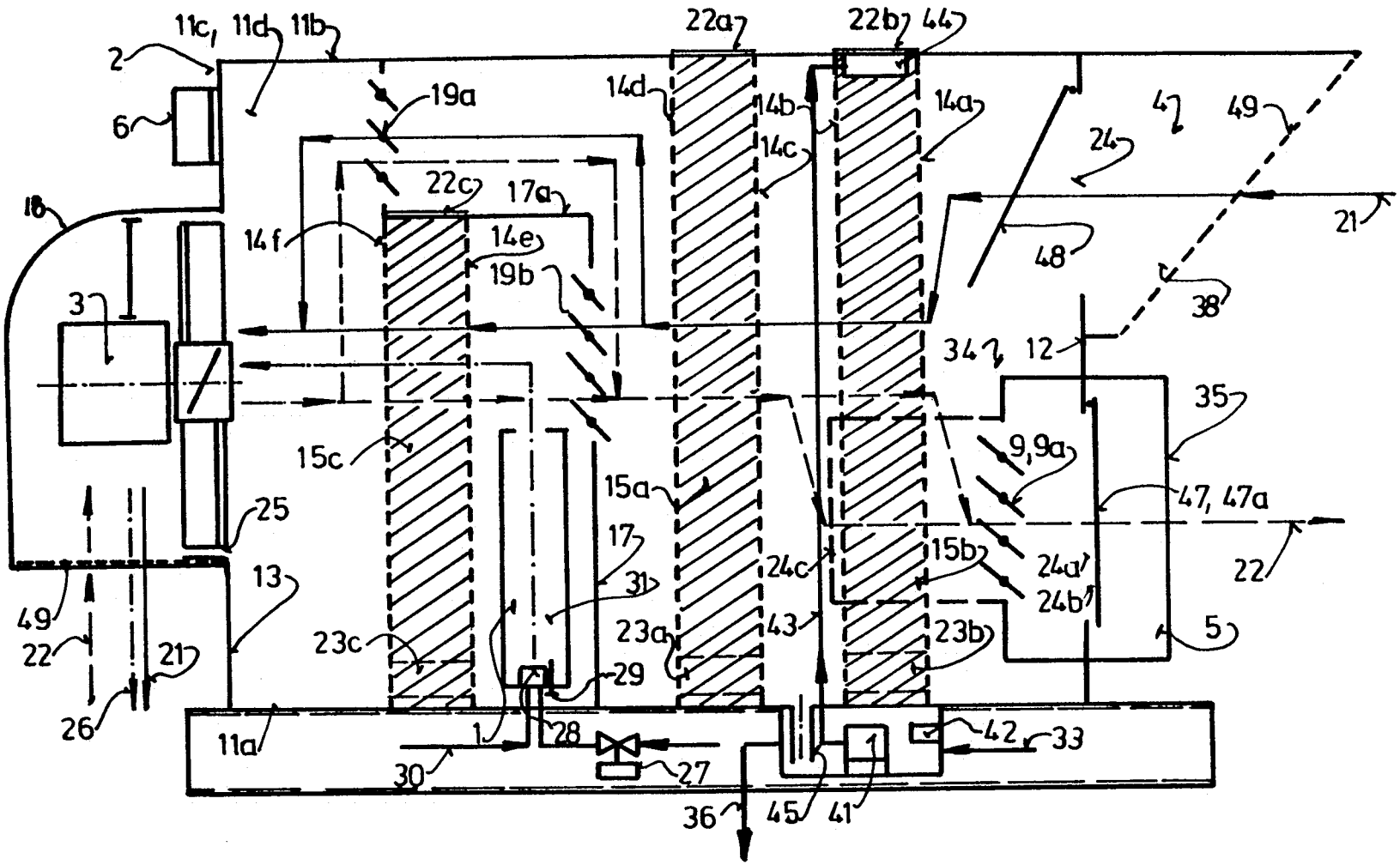
FIG. 4 is a schematic of one preferred embodyment of the apparatus of the present invention intended for use in cooling of buildings.

While the apparatus of FIG. 1 has been described with the use of two exhaust fans 3, 3=operating alternately, it is also feasible to replace the two exhausters with a single 4-way tube axial air fan as described in the embodyment of FIGS. 2, 3, or with two 2-way tube axial air fans as described in the embodyment of FIG. 4.

While the embodyment of FIG. 1 has been described as an effective combination of an ultra high energy efficient periodic flow type air heater with an ultra high energy efficient periodic flow type indirect-direct evaporative cooler, and as a high energy efficient periodic flow type energy recovery ventilator for heating, cooling and ventilation of buildings, it can be appreciated, that to utilize the benefits of the present invention the described apparatus can be easily adapted to provide:

an ultra high energy efficient heater for heating of air or of an industrial gas where the cooling and ventilation features are not required, an ultra high energy efficient periodic flow type heater-ventilator for applications where cooling is not required, an ultra high energy efficient indirect-direct evaporative cooler for applications where heating is not required, and an energy efficient heat recovery ventilator.

If used as an ultra high energy efficient heater-ventilator, the matrix materials in containers 2, 2* may include a suitable desiccant to increase the effectiveness in recovery (or rejection) of the latent heat from the warm air stream.

To utilize the benefits of the invented ultra high energy efficient indirect-direct evaporative cooler-ventilator in cooling and ventilation of buildings, it can be also appreciated, that the invented indirect-direct evaporative cooler-ventilator can be also conveniently combined with a conventional gas fired, oil fired, or an electric heater to provide the required heating, cooling and ventilation of the building.

While FIG. 1 shows a combination of the invented periodic flow type heater with the invented periodic flow type indirect-direct evaporative cooler, it can be appreciated, that the indirect-direct evaporative cooler can be enhanced by addition of a desiccant as described under embodyment of FIG. 4 to provide effective cooling of air in locations with occasional high temperature-high humidity conditions when the indirect-direct evaporative cooling is ineffective.

While FIG. 1 shows a schematic arrangement of parts in a vertical configuration of the apparatus for use in heating, cooling and ventilation of houses and buildings, it can be appreciated that the described parts can be also arranged in a horizontal configuration for use in large buildings and or in industrial process heating-cooling applications.

FIGS. 2, 3 show another preferred embodyment of the present invention intended for use as a roof top heat recovery ventilator-heater-indirect-direct evaporative cooler. It includes the apparatus of FIG. 1 excluding the air blower 8, flue gas discharge check valves 10, 10*, and is in addition provided with gravity back draft dampers 48, 48* for drawing the exhaust air 20 from the exhaust air compartment 4 into matrix containers 2, 2*, and gravity back draft dampers 47, 47* for discharging the treated outdoor air from containers 2, 2* into the supply air compartment 5.

Apparatus of FIGS. 2, 3 is intended for a 100% make up air ventilation-heating-cooling. The cyclic combustion process of the embodyment of FIGS. 2, 3 is same as that described under embodyment of FIG. 1, however, since the return air compartment 4 is not in communication with the supply air compartment 5, there is no need for the flue gas discharge check valves 10,10* described in the embodyment of FIG. 1.

The substantially continuous, alternate and countercurrent flow of the two air streams through the two containers 2, 2* and the apparatus is achieved by a single 4-way tube axial air fan 3. The 4-way tube axial air fan 3 uses a single 4-way housing provided with two axial fixed blade propellers driven by a single direct drive plug reversing electric motor permitting continuous instant reversing of the rotation of the two air propellers, and thus instant switching of the two air streams between the two containers 2, 2*. The duration time of the switching period is very short, about 1 sec. for a tested ⅓ Hp motor, and the duration time of the operating cycle can be as short as 20 sec.

Alternately, the rotation of the two axial fixed blade propellers may be by a belt driven plug-reversing electric motor, or by a reversible electric drive provided with brakes, or by a unidirectional drive in combination with electric or mechanical clutches.

Alternately, the 4-way tube axial air fan 3 may include a single 4-way housing provided with two axial air propellers with adjustable blades driven by a unidirectional drive with the propeller blades changing their position in the middle of the operating cycle under the influence of the processor 6, thus affecting switching of the two air streams between the two containers. Alternately, the 4-way tube axial air fan may be replaced by four alternately operating axial or radial type air fans.

While the embodyments of FIGS. 1, 2, 3 were described with use of a fuel combustor to generate the heat for heating of the air for heating of a building, it can be appreciated that it is also feasible to combine the invented indirect-direct evaporative cooler-heat recovery ventilator with an electric heater to provide the ultra high energy efficient heating, heat recovery ventilation of the building during the winter heating season and to provide the ultra high energy efficient indirect-direct evaporative cooling and ventilation of the building during the summer cooling season.

Similarly as described under the embodyment of FIG. 1, the apparatus of FIGS. 2, 3 can be easily adapted to provide:

an ultra high energy efficient air heater, an ultra high energy efficient air heater-ventilator, an ultra high energy efficient indirect-direct evaporative cooler, and a high energy efficient energy recovery ventilator.

The invented ultra high energy efficient indirect-direct evaporative cooler-ventilator can be also combined with a conventional gas fired, oil fired or an electric furnace to provide heating, cooling and ventilation of buildings as already pointed out under the embodyment of FIG. 1.

FIG. 4 is a schematic illustration of another preferred embodyment of the apparatus of the present invention intended for cooling of air for use in cooling and ventilation of buildings, houses and mobile homes in locations with occasional high temperature-high humidity conditions when the indirect-direct evaporative cooling is ineffective. As indicated in FIG. 4 the apparatus includes a single matrix container 2 of the embodyments of FIGS. 1, 2, 3, a single 2-way tube axial air fan 3, an air intake compartment 4, a supply air compartment 5, and the processor 6. As indicated by dashed lines there is an alternate intake **24*c* into the supply air compartment 5 including an additional damper 9*a* and a back draft damper 47*a*, with the intake 24*c* located between matrix beds 15*a*, 15*b***.

The matrix container 2 in addition includes partitions 17, **17*a* separating the matrix container into a first chamber including matrix beds 15*a*, 15*b*, and a second chamber including matrix bed 15*c* containing a suitable desiccant and a heater 1**.

The heater may be a direct gas fired heater, or it may be a built in electric heater, or a tubular heat exchanger with a hot fluid flowing through it, with the hot fluid being a liquid or a gas, with the heater preferably operating periodically and at the end of the desorption period.

Partition 17 is provided with air dampers **19*a*, 19*b* permitting passage of the two air streams either through the three matrix beds 15*c*, 15*a*, 15*b* when damper 19*a* is closed and damper 19*b* is opened, or only through beds 15*a*, 15*b* when damper 19*b* is closed and damper 19*a*** is opened.

With the two air streams passing only through beds **15*a*, 15*b* the apparatus operates as a periodic flow type indirect-direct evaporative cooler as described under embodyment of FIG. 1**.

With the two air streams passing through the three beds **15*c*, 15*a*, 15*b*** the apparatus operates as an ultra high energy efficient dehumidifier-indirect-direct evaporative cooler.

With the damper 9 closed and damper **9*a*** opened, with the two air streams passing through both first and second chambers the apparatus operates as a dehumidifier-indirect evaporative cooler, and with the two air streams passing only through the first chamber as an indirect evaporative cooler.

The apparatus of FIG. 4 is shown as using the outdoor air 21 for cooling of the matrix material in bed **15*a* and the air intake compartment 4 is therefore provided with a screen 49. It can be appreciated, however, that the cooling of the matrix material in bed 15*a* can be also arranged by the exhaust air as described in embodyment of FIG. 1, by connecting the intake compartment 4** to the return air duct of the building air duct system.

The periodic flow of the two air streams 21, 22 through the matrix container 2 is provided by a 2-way tube axial air fan 3 controlled by the processor 6. The 2-way tube axial air fan 3 includes a 2-way housing 18 including a single tube axial fixed blade type propeller driven by a direct drive plug reversing electric motor.

The housing 18 of the 2-way tube axial air fan 3 is conveniently attached to the rear wall 13 over the opening 25 of the matrix container 2.

Similarly, as in embodyments of FIGS. 2,3, the 2-way tube axial air fan may be driven by a belt driven plug-reversing electric motor, or by a unidirectional electric drive in combination with clutches, or alternately, the axial type propeller may have adjustable blades when driven by a unidirectional electric drive, or the 2-way tube axial air fan may be replaced by two alternately operating axial or radial type air fans.

The operation of the apparatus as a dehumidifier-indirect-direct evaporative cooler is as follows:

The processor 6 maintains the air dampers 19*a*, 9*c* closed, the air damper 19*b*, 9 opened, the water pump 41 on, and the operation of the air fan 3 in a reversing mode. The flow of the two air streams is periodic, countercurrent, and substantially balanced. The heat and mass transfer operations that are occurring in the matrix container are as follows:

During one part of the operating cycle—i.e. sorption period:

The air fan 3 draws the warm and humid outdoor air 22 from outdoor through screen 49, opening 25, bed of desiccant 15*c*, bed of heat absorbing material 15*a*, wet bed 15*b* into chamber 34 and out via damper 9, back draft damper 47 into the supply air compartment 5 and out of apparatus via opening 35.

The warm humid outdoor air when passing through matrix container is dehumidified by the active desiccant in bed 15*c*, the released sorption heat and the residual heat retained by the desiccant from the preceded desorption period are conveyed by the heated dehumidified air into the bed of the heat absorbing material 15*a* which bed during the preceded desorption period was cooled by the outdoor air adiabatically cooled in wet bed 15*b*. Simultaneously, as the heat absorbing material in bed 15*a* is being heated, the dehumidified outdoor air passing through bed 15*a* is being cooled. With respect to the perfectly countercurrent flow of the two air streams through the three beds 15*c*, 15*a*, 15*b*, the dehumidified outdoor air when passing through the bed of the heat absorbing material 15*a* is cooled down very close to the temperature of the previously adiabatically cooled outdoor air. Because of the large surface area and heat storage capacity of bed 15*a*, and because of the perfectly countercurrent flow of the two air streams, sensible heat transfer effectiveness as high as 95% in bed 15*a* is economically feasible. Finally, when the dehumidified and cooled outdoor air is forced through the wet bed 15*b* it is washed, humidified and adiabatically cooled to a low temperature at which the outdoor air is discharged from the matrix container 2 into the supply air compartment 5 and out via opening 35.

When the processor 6 reverses the rotation of the electric motor of the air fan 3 in the middle of the operating cycle, then during the other period, i.e. desorption period:

The outdoor air 21 is drawn by air fan 3 from the intake compartment 4 into chamber 34, then in the matrix container 2 through beds 15*b*, 15*a*, 15*c*. When passing through the wet bed 15*b* the outdoor air 21 is washed and adiabatically cooled. When passing through the bed 15*a* of the heat absorbing material, which bed was heated during the preceded sorption period, the outdoor air is heated up by absorbing heat released from the heat absorbing material while the heat absorbing material is being cooled. As the temperature of the air is increased, its relative humidity is reduced and its capacity to remove moisture from the desiccant is increased. Because of the high thermal effectiveness of the packed bed of the heat absorbing material 15*a* in retaining sorption heat, major portion of the adsorbed moisture can be removed from the desiccant during the desorption period by the preheated air without using the heater 1. To remove the residual moisture from the desiccant, shortly before the end of the desorption period processor 6 automatically turns on the heater 1 which then rises the temperature of the preheated air to complete the reactivation of the desiccant in bed 15*c*. During the desorption period the air with the released moisture is discharged out via opening 25 to outdoor.

With the three bed matrix in container 2 the enthalpy of the incoming outdoor air can be reduced below the enthalpy of the indoor air as required to provide cooling of the building even under conditions of high humidity of the outdoor air.

If it is desired, a continuous stream of a cool fresh air can be conveniently provided by two such described units of the embodyment of FIG. 4 controlled by a single processor 6, with the processor continuously reversing the rotation of the electric drives of the two air propellers in the middle of the operating cycle. It can be appreciated, that it would be feasible to operate two units of the embodyment of FIG. 4 by a single 4-way tube axial air fan as described in embodyment of FIGS. 2, 3.

The described embodyment offers the least expensive apparatus permitting the ultra high energy efficient periodic flow type indirect-direct evaporative cooling of air during periods of high temperature with relatively low humidity, and the ultra high energy efficient dehumidification-indirect-direct evaporative cooling of air during periods of high humidity for cooling and ventilation of buildings permitting significant reduction in consumption of fuel and power as compared with the current art vapour compression systems, absorption systems, desiccant-cooling systems and the indirect-direct evaporative systems.

As already pointed out, with the intake of the supply air compartment 5 located between the two matrix beds 15*a*, 15*b*, with damper 9 closed and damper 9*b* opened the desribed apparatus in addition can also operate as an ultra high energy efficient dehumidifier-indirect evaporative cooler or as an indirect evaporative cooler.

While the apparatus of the embodyments of FIGS. 1, 2, 3, 4 has been described with the matrix containers housing the matrix materials as being generally of a rectangular shape, it can be appreciated, that the shape of the matrix containers can be made also cylindrical, and either horizontal or vertical.

Since the apparatus of the present invention is simple, the cost of the used matrix materials is minimal, the life of the matrix materials is substantially infinite, the used heat and mass transfer surfaces are large and the heat and mass transfer effectiveness is superior, and the ducting, noise and contamination of the supply air with combustion products is eliminated, and the modulation of the performance is simple and reliable, both the capital and the operating costs of the invented apparatus in heating cooling and ventilation of buildings are expected to be substantially lower than that of the prior art.

The invented apparatus can be applied to a number of different uses in heating, ventilation and cooling of individual homes, residential, commercial and industrial buildings, as well as in numerous industrial processes requiring hot clean process gas or air for processing or heating; or cool air for process cooling, as an ultra high energy efficient air heater, ventilator, indirect evaporative cooler, indirect-direct evaporative cooler, dehumidifier, and or dehumidifier-indirect-direct evaporative cooler.

SUMMARY OF THE DISCLOSURE

In summary of this disclosure, the present invention provides a compact ultra high energy efficient air heater, cooler, dehumidifier and ventilator for use in heating, cooling and heat recovery ventilation of buildings and in industrial process heating, dehumidification and cooling operations.

The apparatus is simple, compact, highly reliable, operates at atmospheric pressures, with no leakage, no noise, substantially maintenance free with reduced flow resistances and increased effectiveness.

The invented ultra high energy efficient air heater combines commercially available components with a periodic flow type stationary matrix energy exchanger to achieve the ultra high energy efficient heating and ventilation of buildings with avoiding the condensation of moisture in flue gases.

The invented ultra high energy efficient indirect-direct evaporative cooler combines a periodic flow type sensible heat transferring heat exchanger with a periodic flow type humidifier to achieve a substantially increased effectiveness of the involved sensible and adiabatic cooling of the treated air in a single matrix container. The cooling performance of the apparatus can be further enhanced by addition of a desiccant into the matrix container intended for locations with occasional high humidity of the ambient air when the indirect-direct evaporative cooling becomes ineffective.

The invented high energy efficient heater-cooler-dehumidifier-ventilator combines the invented heater and the invented indirect-direct evaporative cooler into an integrated apparatus intended for use in buildings to provide the required heating-ventilation of the buildings during the heating season, the required cooling-ventilation of the buildings during the cooling season, and the required ventilation of the buildings during the rest of the year at reduced capital and operating costs.

While the present invention has been described with reference to specific embodiments, and in specific applications to demonstrate the features and advantages of the invented apparatus, such specific embodiments are susceptible to modifications to fit other configurations or other applications. Accordingly, the forgoing description is not to be construed in a limiting sense.

What is claimed is:

1. Apparatus for ultra high energy efficient heating, cooling and dehumidifying of air, said apparatus comprising:

combustion means for generating useful heat for heating of an air stream, said combustion means including combustion control means and flue gas discharge means, matrix container means including at least one matrix container for retaining matrix means, with each said container including front, rear and side walls, and screen means separating each said container into first, second, and third consecutive chambers, said first and third chambers having at least one intake-exit opening for intake and for exit of first and second air streams, said second chamber housing said matrix means and having flanged openings for replacement of said matrix means, said matrix container means operating in a short cycle including a sorption and desorption periods, matrix means including at least a single matrix means including solid materials for removing of particulates and for absorbing heat and moisture from said first air stream and for simultaneously cooling said first air stream during said sorption period, and then releasing said particulates and said heat and moisture into said second air stream and simultaneously heating said second air stream during said desorption period, air fan means for pumping said two air streams periodically through said matrix container means in preselected time intervals, said air fan means pumping said two air streams alternately and countercurrently to each other through said matrix container means and said matrix means during said sorption and desorption periods to facilitate countercurrent transfer of heat and moisture between said two air streams, compartment means in communication with said matrix container means, said compartment means housing said combustion means and including an intake and an exit means for intake and exit of said two air streams, and process control means interconnected with said matrix means and said air fan means, and provided for controlling said operating cycle of said matrix means by regular periodic switching of said air fan means, and for maintaining a continuous operation of said apparatus operating in either of a heating mode, cooling mode, and or a dehumidifying mode.

2. Apparatus of claim 1 with the flue gas generated in said combustion means being discharged via said flue gas discharge means to outdoors.

3. Apparatus of claim 1 with said combustion means being in communication with said matrix container means through said flue gas discharge means with said flue gas being discharged via said flue gas discharge means into and through said matrix container means together with one of said two air streams to outdoors.

4. Apparatus of claim 3 with said combustion control means being interconnected with and controlled by said process control means, with said process control means controlling said operation of said combustion means, with said combustion means operating in a cyclic mode, with the combustion reactions occurring in said combustion means being carried out in a cyclic combustion process controlled and maintained by said process control means, with said cyclic combustion process comprising a short combustion period followed by a short venting period, with said flue gas discharge means eliminating the leakage and carry over of said flue gas into said heated air stream.

5. Apparatus as claimed in claims 2, 3, or 4 including in addition means for recirculation of an air stream including blower means, filter means and damper means, with said compartment means including intake exit-means for intake and exit of said first and second air streams and said recirculated air stream, and having partition means for directing one of said first and second air streams into said blower means, with said blower means being controlled by said process control means.

6. Apparatus of claim 5 with said air fan means drawing said flue gas with one of said first and second air streams from said compartment means alternately into, through and out of said matrix container means and out of said apparatus, with said blower means drawing alternately said the other air stream into, through, and out of said matrix container means into said compartment means and then together with said recirculated air stream through said compartment means out of said apparatus.

7. Apparatus of claims 2, 3, or 4 with said matrix container means including in addition heater means for reactivation of said matrix means.

8. Apparatus of claim 7 including in addition means for recirculation of an air stream including blower means, filter means and damper means, with said compartment means including intake exit means for intake and exit of said first and second air streams and said recirculated air stream, and having partition means for directing one of said first and second air streams into said blower means, with said blower means being controlled by said process control means.

9. Apparatus of claim 8 with said air fan means drawing said flue gas with one of said first and second air streams from said compartment means alternately into, through and out of said matrix container means and out of said apparatus, with said blower means drawing alternately said the other air stream into, through and out of said matrix container means into said compartment means and then together with said recirculated air stream through said compartment means out of said apparatus.

10. Apparatus of claims 2, 3, or 4 with said matrix means including first matrix and a second matrix, with said first matrix including solid materials for removing particulates and for absorbing heat and moisture from one of said two air streams during said sorption period and then releasing said particulates and said absorbed heat and moisture into said other air stream during said desorption period, with said second matrix including solid materials with wetting means, with said second matrix operating either in a dry or a wet operating modes, with said second matrix absorbing and releasing heat when operating dry, and washing, humidifying and cooling said two air streams when operating wet during said sorption and desorption periods, with said process control means in addition controlling said dry and wet operations of said second matrix.

11. Apparatus of claim 10 with said matrix container means including in addition heater means for reactivation of said matrix means.

12. Apparatus of claims 10 or 11 including in addition means for recirculation of an air stream including blower means, filter means and damper means, with said compartment means including intake exit means for intake and exit of said first and second air streams, and having partition means for directing one of said first and second air streams into said blower means, with said blower means being controlled by said process control means.

13. Apparatus of claim 12 with said air fan means drawing said flue gas with one of said first and second air streams from said compartment means alternately into, through and out of said matrix container means and out of said apparatus, with said blower means drawing alternately said the other air stream into, through and out of said matrix container means into said compartment means and then together with said recirculated air stream through said compartment means out of said apparatus.

14. Apparatus of claims 2, 3 or 4 with each said matrix container means including partition means with damper means separating each said matrix container into first and second chambers, said partition with damper means provided for permitting passage of said first and second air streams either through one or through both said chambers, with both said chambers including matrix means, with said first chamber including first and second matrix, with said first said matrix including solid materials for absorbing heat from one of said two air streams during said sorption period and then releasing said absorbed heat into said other air stream during said desorption period, with said second matrix including solid materials with wetting means, with said second matrix operating either in a dry or a wet operating mode, with said second matrix absorbing and releasing heat when operating dry, and washing, humidifying and cooling said two air streams when operating wet during said sorption and desorption periods, with said process control means controlling said dry and wet operations of said second matrix, with said second chamber including third matrix including desiccant means for removing moisture from one of said two air streams during said sorption period and then releasing said moisture into said other air stream during said desorption period.

15. Apparatus of claim 14 with said matrix container means including in addition heater means for reactivation of said desiccant means.

16. Apparatus of claims 14 or 15 including in addition means for recirculation of an air stream including blower means, filter means and damper means, with said compartment means including intake exit means for intake and exit of said first and second air streams, and having partition means for directing one of said first and second air streams into said blower means, with said blower means being controlled by said process control means.

17. Apparatus of claim 16 with said air fan means drawing said flue gas with one of said first and second air streams from said compartment means alternately into, through and out of said matrix container means and out of said apparatus, with said blower means drawing alternately said the other air stream into, through and out of said matrix means into said compartment means and then together with said recirculated air stream through said compartment means out of said apparatus.

18. Apparatus of claims 2, 3, or 4 with said matrix means including first matrix and a second matrix, with said first matrix including solid materials for removing particulates and for absorbing heat from one of said two air streams during said sorption period and then releasing said particulates and said absorbed heat into said other air stream during said desorption period, with said second matrix including solid materials with wetting means, with said second matrix operating either in a dry or a wet operating modes, with said second matrix absorbing and releasing heat when operating dry, and washing, humidifying and cooling said two air streams when operating wet during said sorption and desorption periods, with said process control means in addition controlling said dry and wet operations of said second matrix.

19. Apparatus of claim 18 including in addition means for recirculation of an air stream including blower means, filter means and damper means, with said compartment means including intake exit means for intake and exit of said first and second air streams, and having partition means for directing one of said first and second air streams into said blower means, with said blower means being controlled by said process control means.

20. Apparatus of claim 19 with said air fan means drawing said flue gas with one of said first and second air streams from said compartment means alternately into, through and out of said matrix container means and out of said apparatus, with said blower means drawing alternately said the other air stream into, through and out of said matrix container means into said compartment means and then together with said recirculated air stream through said compartment means out of said apparatus.

* * * * *